US007255634B2

(12) United States Patent
Mizuno et al.

(10) Patent No.: US 7,255,634 B2
(45) Date of Patent: Aug. 14, 2007

(54) DRAINING DEVICE AND LENS PROCESSING SYSTEM HAVING THE SAME

(75) Inventors: Toshiaki Mizuno, Aichi (JP); Yoshinori Matsuyama, Aichi (JP); Hirokatsu Obayashi, Aichi (JP)

(73) Assignee: Nidek Co., Ltd., Aichi (JP)

( * ) Notice: Subject to any disclaimer, the term of this patent is extended or adjusted under 35 U.S.C. 154(b) by 0 days.

(21) Appl. No.: 11/498,096

(22) Filed: Aug. 3, 2006

(65) Prior Publication Data

US 2006/0270324 A1 Nov. 30, 2006

Related U.S. Application Data

(62) Division of application No. 10/603,927, filed on Jun. 26, 2003, now Pat. No. 7,108,590.

(30) Foreign Application Priority Data

Jun. 28, 2002 (JP) ..... P2002-190736

(51) Int. Cl.
*B24B 9/00* (2006.01)

(52) U.S. Cl. ..... 451/67; 451/255; 451/256; 451/384; 451/388

(58) Field of Classification Search ..... 34/463, 34/464, 465, 508, 130; 451/41, 42, 43, 54, 451/64, 65, 67, 242, 244, 246, 251, 254, 451/255, 256, 384, 388, 390
See application file for complete search history.

(56) References Cited

U.S. PATENT DOCUMENTS

| | | | | |
|---|---|---|---|---|
| 5,335,394 | A | 8/1994 | Cunningham, Jr. et al. | |
| 5,545,076 | A | 8/1996 | Yun et al. | |
| 5,577,950 | A | 11/1996 | Smith et al. | |
| 5,674,115 | A | 10/1997 | Yamashita et al. | |
| 5,679,060 | A | 10/1997 | Leonard et al. | |
| 5,716,256 | A | 2/1998 | Mizuno et al. | |
| 6,074,280 | A * | 6/2000 | Mizuno et al. | 451/42 |
| 6,159,072 | A | 12/2000 | Shibata | |
| 6,338,350 | B1 | 1/2002 | Ewen | |
| 6,379,215 | B1 | 4/2002 | Mizuno et al. | |
| 6,427,094 | B1 | 7/2002 | Mizuno | |
| 6,538,573 | B2 * | 3/2003 | Mizuno | 340/618 |
| 6,572,460 | B2 * | 6/2003 | Mizuno | 451/178 |

FOREIGN PATENT DOCUMENTS

| | | |
|---|---|---|
| JP | 9-253999 A | 9/1997 |
| JP | 11-287972 A | 10/1999 |

* cited by examiner

*Primary Examiner*—Timothy V. Eley
(74) *Attorney, Agent, or Firm*—Sughrue Mion, PLLC

(57) ABSTRACT

A draining device for removing processing water attached to a lens includes: a first lens holding shaft to which a cup attached to a refractive surface of the lens as a processing jig can be fitted; and a rotating unit which rotates the first lens holding shaft to remove the water by centrifugal force.

4 Claims, 9 Drawing Sheets

DRAINING DEVICE AND LENS PROCESSING SYSTEM HAVING THE SAME

This application is a divisional of application Ser. No. 10/603,927 filed Jun. 26, 2003 now U.S. Pat No. 7,108,590. The entire disclosure of the prior application, application Ser. No. 10/603,927 is considered part of the disclosure of the accompanying divisional application and is hereby incorporated by reference.

BACKGROUND OF THE INVENTION

The present invention relates to a lens processing system for processing a lens and a draining device for removing processing water attached to a processed lens.

In eyeglass lenses, for example, the processing of lenses, which has conventionally been performed individually at optician's shops, has in recent years come to be performed intensively at a processing center. In the processing center, a multiplicity of lenses are processed intensively in response to orders from optician's shops. In this intensive processing, it is desired that labor saving (automation) be attained as practically as possible in a series of steps related to lens processing. For this reason, a lens processing system has been proposed in which an unprocessed lens is taken out from a lens accommodating tray or the like, is conveyed, and is set in a lens processing device, and a processed lens is taken out from the processing device, is conveyed, and is placed (returned) on the tray or the like.

However, in the conventional lens processing system, a many steps which an operator has to perform still exists. For example, at the time of lens processing, in order to cool a processed part of the lens and remove chaff by processing, processing water is supplied. However, if the processed lens to which the water is attached is kept as it is, it can cause change in quality of the surface of lens, that is, water marks. Therefore, the operator has to perform an operation to remove the water attached to the lens after processing.

SUMMARY OF THE INVENTION

In view of the above-described problems of the conventional art, an object of the present invention is to provide a draining device and a lens processing system which permit saving the processing step.

In order to solve the aforesaid object, the invention is characterized by having the following arrangement.

Aspect 1. A draining device for removing processing water attached to a lens comprising:

a first lens holding shaft to which a cup attached to a refractive surface of the lens as a processing jig can be fitted; and a rotating unit which rotates the first lens holding shaft to remove the water by centrifugal force.

Aspect 2. The draining device according to the aspect 1 further comprising a second lens holding shaft coaxial with the first lens holding shaft for holding the lens by a relative movement with respect to the first lens holding shaft.

Aspect 3. A draining device for removing processing water attached to a lens comprising:

a lens holding member to which a cup attached to a refractive surface of the lens as a processing jig can be fitted; and an air jetting unit which jets air toward opposite refractive surfaces of the lens held by the lens holding member to remove the water by jetting air.

Aspect 4. The draining device according to the aspect 3 further comprising a moving unit which moves the lens holding member relative to the air jetting unit.

Aspect 5. A lens processing system comprising:

a lens processing device;

a draining device which removes processing water attached to the lens; and a lens conveying device which takes out a processed lens from the lens processing device and conveys and sets the processed lens to the draining device.

Aspect 6. The lens processing system according to the aspect 5, wherein the lens processing device includes a first lens holding part to which a cup attached to a refractive surface of the lens as a processing jig can be fitted, the draining device includes a second lens holding part to which the cup attached to the refractive surface of the lens can be fitted, and the lens conveying device takes out the cup and the processed lens from the first lens holding part and conveys and sets the processed lens to the second lens holding part.

Aspect 7. The lens processing system according to the aspect 6, wherein the draining device includes, a first lens holding shaft as the second lens holding part, and a rotating unit which rotates the first lens holding shaft to remove the water by centrifugal force.

Aspect 8. The lens processing system according to the aspect 7, wherein the draining includes a second lens holding shaft coaxial with the first lens holding shaft for holding the lens by a relative movement with respect to the first lens holding shaft.

Aspect 9. The lens processing system according to the aspect 6, wherein the draining device includes, a lens holding member as the second lens holding part, and an air jetting unit which jets air toward opposite refractive surfaces of lens held by the lens holding member to remove the water by jetting air.

Aspect 10. The lens processing system according to the aspect 9, wherein the draining device includes a moving unit which moves the lens holding member relative to the air jetting unit.

Aspect 11. The lens processing system according to the aspect 5, wherein the draining device includes, a lens holding part which holds the lens, and a rotating unit which rotates the lens holding part to remove the water by centrifugal force.

Aspect 12. The lens processing system according to the aspect 5, wherein the draining device includes, a lens holding part which holds the lens, and an air jetting unit which jets air toward opposite refractive surfaces of lens held by the lens holding member to remove the water by jetting air.

Aspect 13. The lens processing system according to the aspect 5 further comprising a lens stocking device capable of stocking a plurality of lenses, wherein the lens conveying device takes out the processed lens from the draining device and conveys the processed lens to the lens stocking device.

Aspect 14. The lens processing system according to the aspect 13, wherein the lens stocking device can stock a plurality of lens accommodating trays, each of which can accommodates a pair of left and right eyeglass lenses.

DETAILED DESCRIPTION OF PREFERRED EMBODIMENTS

Figure 1:
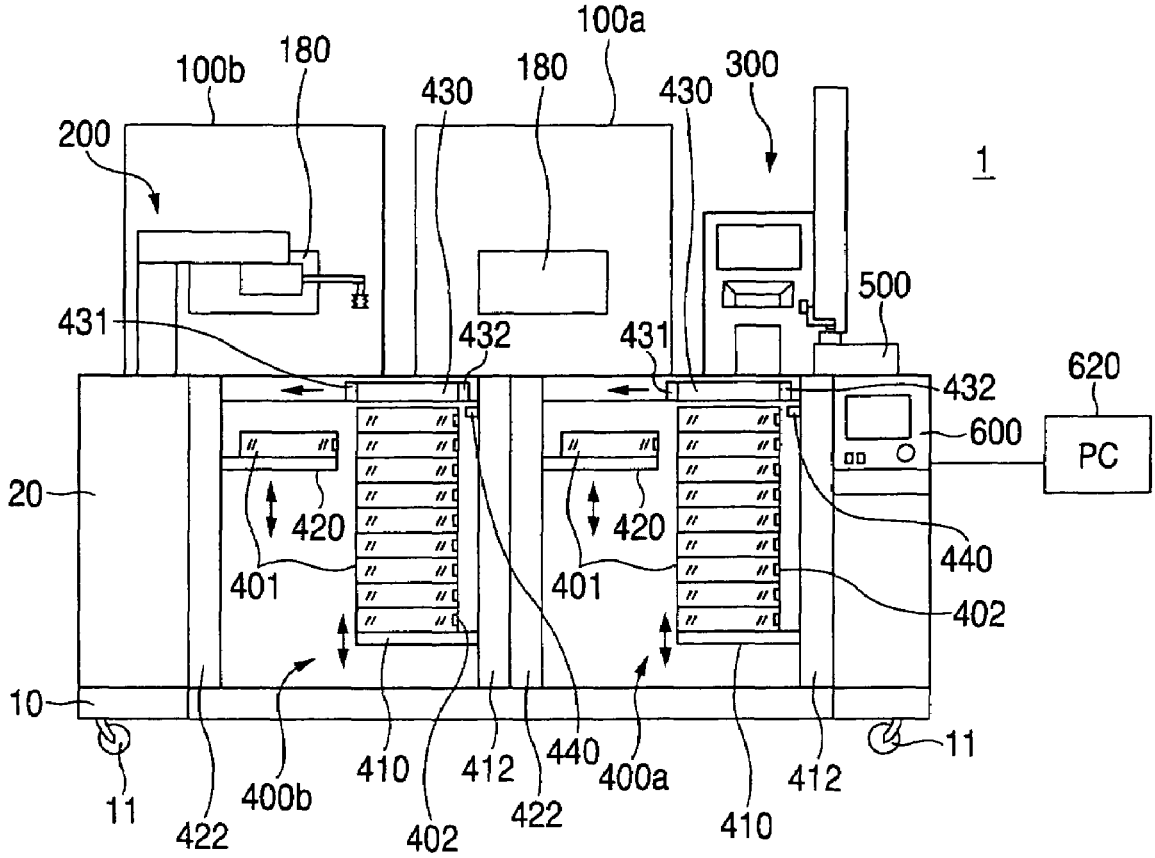
FIG. 1 is a schematic front elevational view of an eyeglass lens processing system in accordance with the invention.
Figure 2:
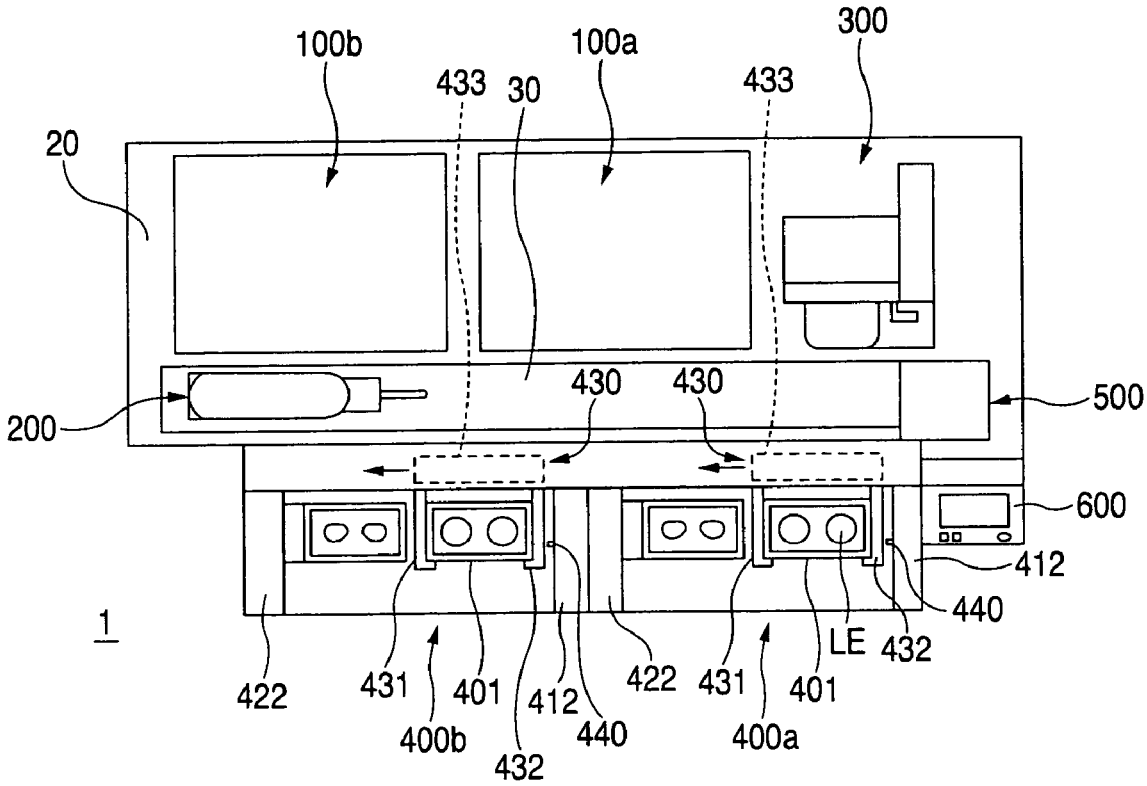
FIG. 2 is a schematic plan view, as taken from above, of the eyeglass lens processing system.

Referring now to the accompanying drawings, a description will be given of an embodiment of the invention. FIG. 1 is a schematic front elevational view of an eyeglass lens processing system in accordance with the invention. FIG. 2 is a schematic plan view, as taken from above, of the eyeglass lens processing system.

An eyeglass lens processing system 1 includes two lens processing devices 100*a* and 100*b* for processing an eyeglass lens LE; a robot hand device (RH device) 200 for conveying the lens LE; a blocking device 300 for attaching a cup serving as a processing jig to the lens LE; two tray (lens) stocking devices 400*a* and 400*b* for stocking lens accommodating trays 401 each adapted to accommodate a pair of left and right lenses LE; a draining device 500 for removing processing water attached to the processed lens; and a system control unit 600 for controlling the various devices. The system control unit 600 is connected to a host computer (host PC) 620 for managing ordering data.

The respective devices are mounted on a base 10 through a table 20. Castors 11 are fitted to the base 10 to allow the overall system 1 (devices) to be integrally movable. In addition, two circulation-type tanks, in which the processing water used by the processing devices 100*a* and 100*b* during processing is stored, are accommodated below (inside) the table 20. The processing water stored in each tank is pumped up by a pump, and is supplied to each of the processing devices 100*a* and 100*b*.

The processing devices 100*a* and 100*b* and the blocking device 300 are installed in such a manner as to be arranged side by side on the table 20. The RH device 200 moves along a straight movement path 30 extending in parallel with the processing devices 100*a* and 100*b*. The stocking devices 400*a* and 400*b* are installed in such a manner as to be arranged side by side on this side of the processing devices 100*a* and 100*b* with the movement path 30 located therebetween. The draining device 500 is installed in the vicinity of a right-hand end portion of the movement path 30. By virtue of the layout of installation of these devices, the state of progress of lens processing is made easy for an operator to observe.

Next, a description will be given of each device provided in the system 1.

<Lens Processing Device>

Figure 3:
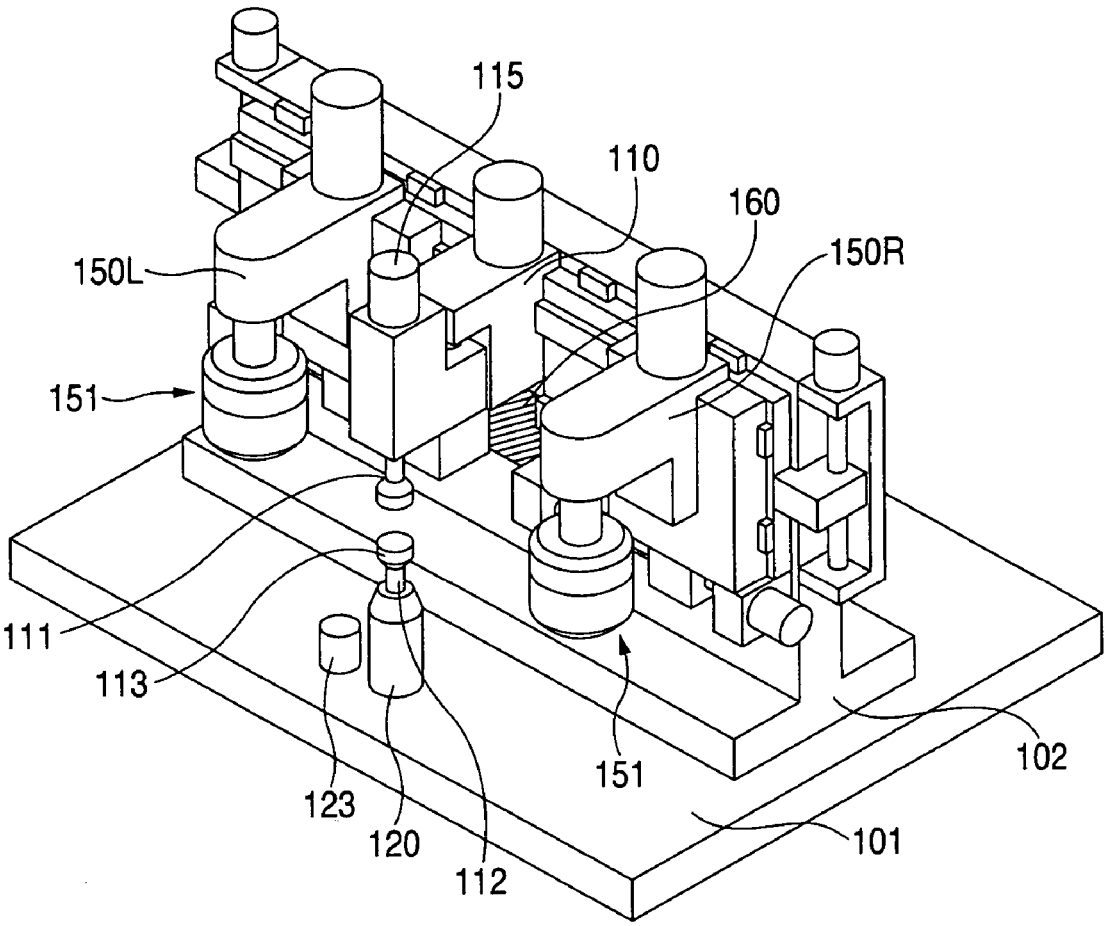
FIG. 3 is a schematic diagram of a lens grinding device.

FIG. 3 is a schematic diagram of the processing device 100*a*. The processing device 100*a* clamps and holds the lens LE by a chuck shaft 111 and a chuck shaft 112 which extend vertically. The upper chuck shaft 111 is moved in the vertical direction by a vertically moving mechanism part 110 provided at the center of a sub-base 102, and is rotated by a motor 115. The lower chuck shaft 112 is rotatably held by a holder 120 fixed to a main base 101, and is rotated in synchronism with the chuck shaft 111 by a motor 123.

Figure 4:
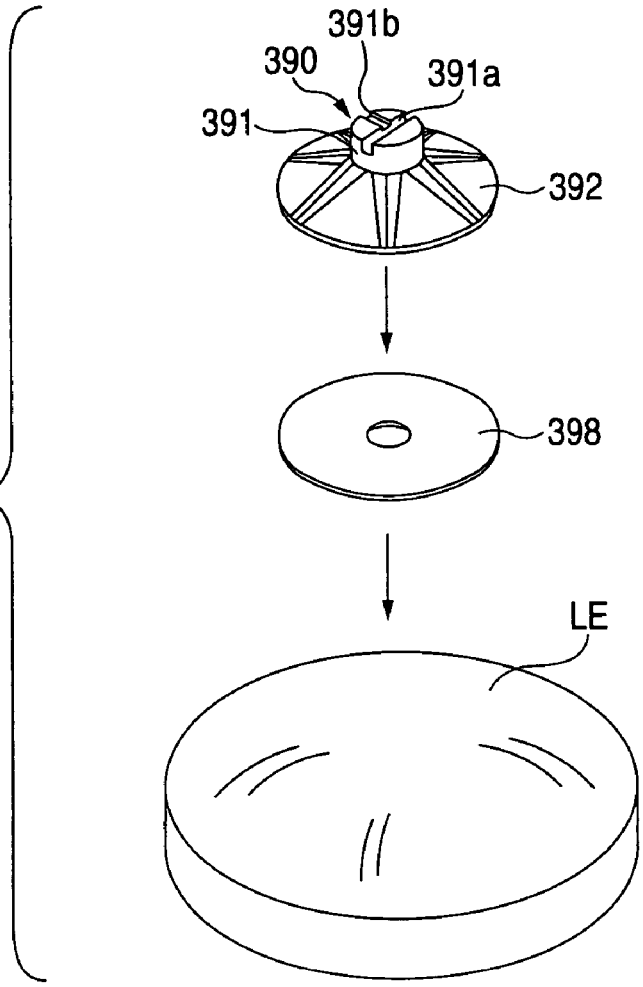
FIG. 4 is a diagram illustrating a schematic construction of a cup and the attachment of the cup to a lens.
Figure 5:
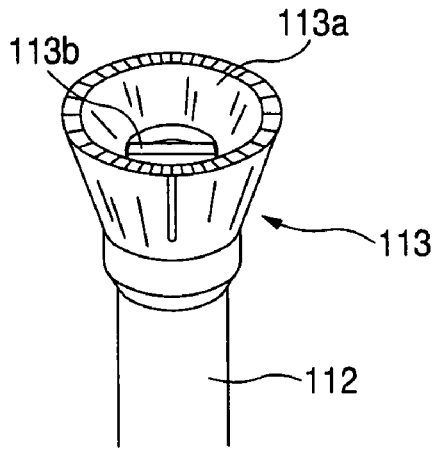
FIG. 5 is a schematic diagram of a cup holder for inserting the cup therein.

To hold the lens LE by the chuck shafts 111 and 112, a cup 390, i.e., a processing jig, is attached in advance to the lens LE by means of an adhesive pad 398, as shown in FIG. 4. The cup 390 is automatically attached by the blocking device 300 which will be described later. The cup 390 has a cylindrical base portion 391 and a flared collar portion 392. A transverse keyway 391*a* and a vertical keyway 391*b* for determining a vertical direction at the time of attaching the lens LE (which direction refers to a vertical direction when the eyeglasses is worn) are formed in the base portion 391. Meanwhile, a cup holder 113 into which the base portion 391 of the cup 390 is inserted is fitted to the chuck shaft 112. As. shown in FIG. 5, a receiving portion 113*a* for receiving the collar portion 392 is formed on the cup holder 113, and a transverse key 113*b* which is fitted in the transverse keyway 391*a* of the base portion 391 is formed on the bottom of the receiving portion 113*a*. During processing, as the transverse keyway 391*a* is fitted to the transverse key 113*b*, the cup 390 attached to the lend LE is fitted to the cup holder 113. The chuck shaft 111 is subsequently lowered to hold the lens LE by the chuck shafts 111 and 112.

The lens LE held by the chuck shafts 111 and 112 is processed from two directions by grinding parts 150R and 150L each having grinding wheels 151 on the respective rotating shaft. Each grinding wheel 151 is constituted by a rough grinding wheel for plastics, a finishing grinding wheel having a V-groove (beveling groove), and a chamfering grinding wheel. The grinding parts 150R and 150L are bilaterally symmetrical, and are respectively moved in the vertical and left-and-right directions by moving mechanisms provided on the sub-base 102.

A lens-shape measuring part 160 is accommodated on a farther side of the center of the sub-base 102. In addition, during the lens processing, the processing water stored in the tanks is sprayed onto the processing portions of the lens LE from unillustrated nozzles. In FIG. 1, reference numeral 180 denotes a processing window. It should be noted that the configuration of this grinding device is basically similar to that of JP-A-9-253999 (U.S. Pat. No. 5,716,256), so that reference is made thereto. The processing device 100*b* has the same configuration as that of the processing device 100*a*.

<RH Device>

Figure 6:
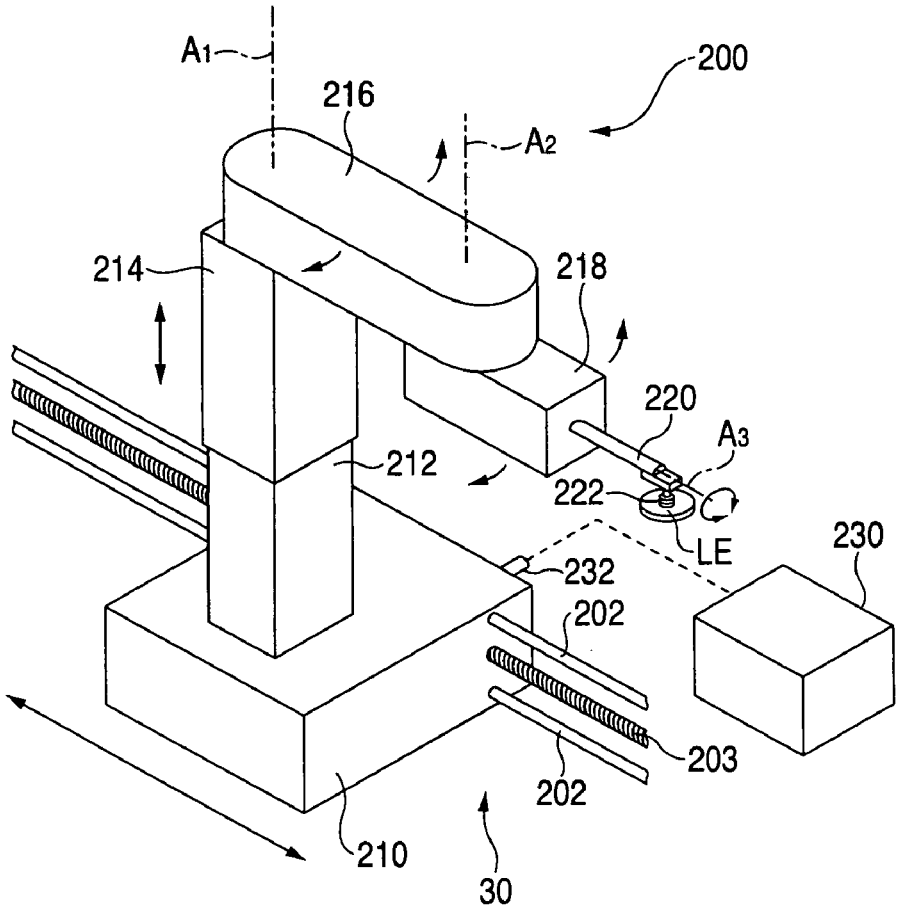
FIG. 6 is a schematic diagram of a robot hand device.

FIG. 6 is a schematic diagram of the RH device 200. As a ball screw 203 is rotated, a traversing base 210 is moved along two rails 202 extending in the direction of the movement path 30. The ball screw 203 is rotated by an unillustrated motor. A base portion 212 is fitted on the traversing base 210. A vertically sliding portion 214 is fitted to the base portion 212 in such a manner as to be vertically movable. The vertically sliding portion 214 is vertically moved by a vertically moving mechanism including a motor, a slide rail, and the like which are provided in the base portion 212. A first arm 216, which rotates about a vertical axis A1, is fitted to an upper portion of the vertically sliding portion 214. The first arm 216 is rotated by a rotating mechanism including a motor and the like which are provided in the vertically sliding portion 214. A second arm 218, which rotates about a vertical axis A2, is fitted to a lower portion of a distal end of the first arm 216. The second arm 218 is rotated by a rotating mechanism including a motor and the like which are provided in the first arm 216. A third arm 220, which rotates about a horizontal axis A3, is fitted to a distal end of the second arm 218. The third arm 220 is rotated by a rotating mechanism including a motor and the like which are provided in the second arm 218. A sucking portion 222 for sucking and holding the lens LE is provided on the lower side of a distal end of the third arm 220.

Figure 7:
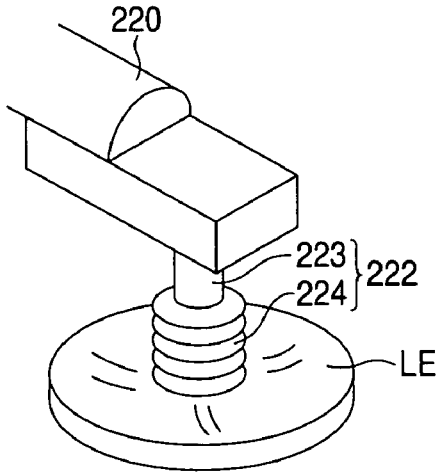
FIG. 7 is a schematic diagram of a sucking portion of the robot hand device.

As shown in FIG. 7, the sucking portion 222 includes a tubular member 223 extending in a direction perpendicular to the horizontal axis A3 and a suction bellows 224 attached to this tubular member 223. The suction bellows 224 is formed of an elastic material such as rubber having a bellows structure. Passages where air passes are respectively formed in the suction bellows 224, the tubular member 223, and the third arm 220, and these passages communicate with a tube 232 connected to an air pump 230. The tube 232 is passed through the traversing base 210, the base portion 212, the vertically sliding portion 214, the first arm 216, and the second arm 218. As the air pump 230 is driven, the lens LE is sucked onto and held by the suction bellows 224. As the driving of the air pump 230 is stopped to return the suction force to the level of the atmospheric pressure, the suction of the lens LE is canceled. In addition, the air pump 230 has a function for delivering air, and as it delivers air through the suction bellows 224, the processing water attached to the lens LE after processing is blown off to a certain degree.

<Blocking Device>

Figure 8:
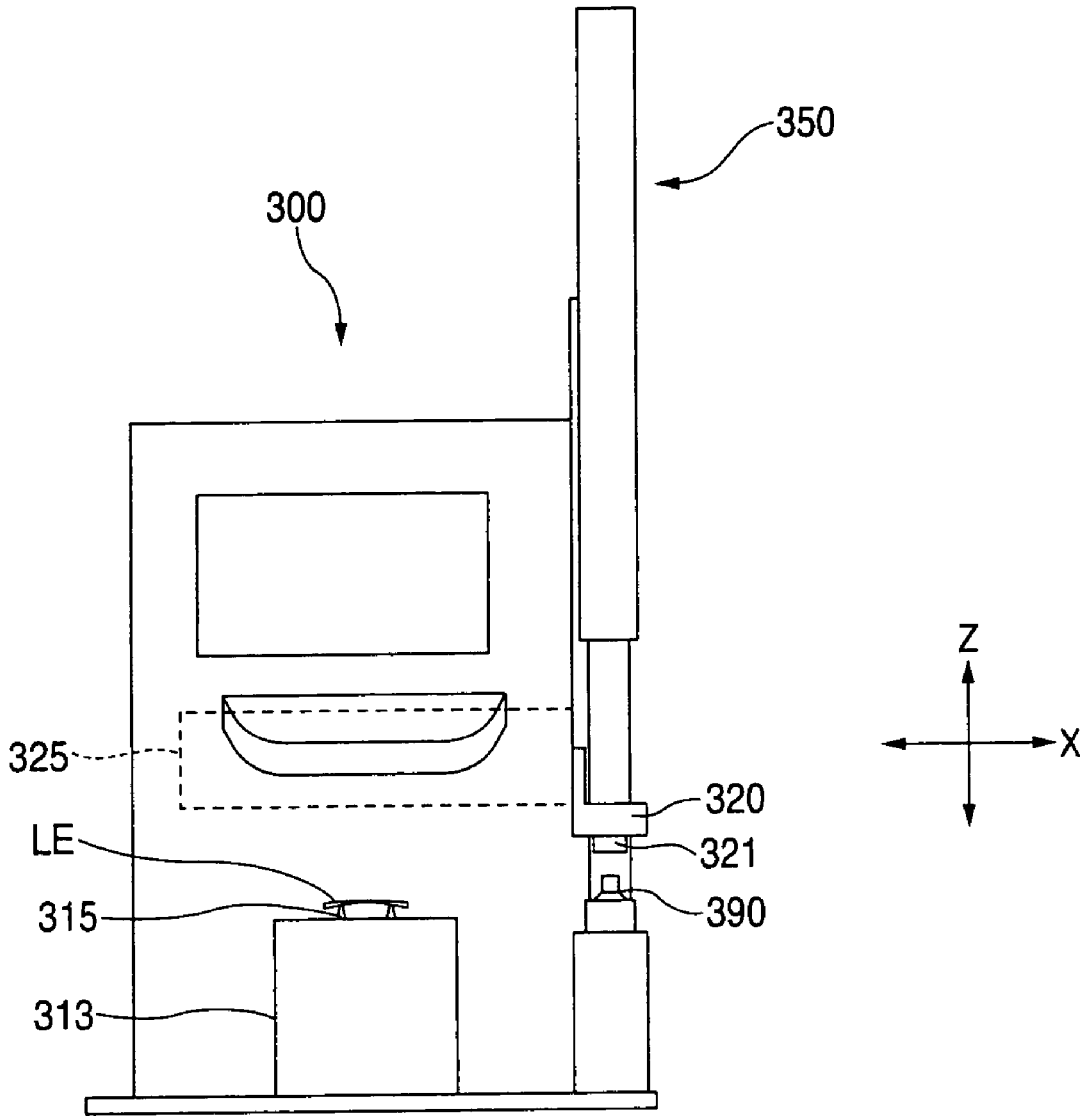
FIG. 8 is a schematic front elevational view of a blocking device.
Figure 9:
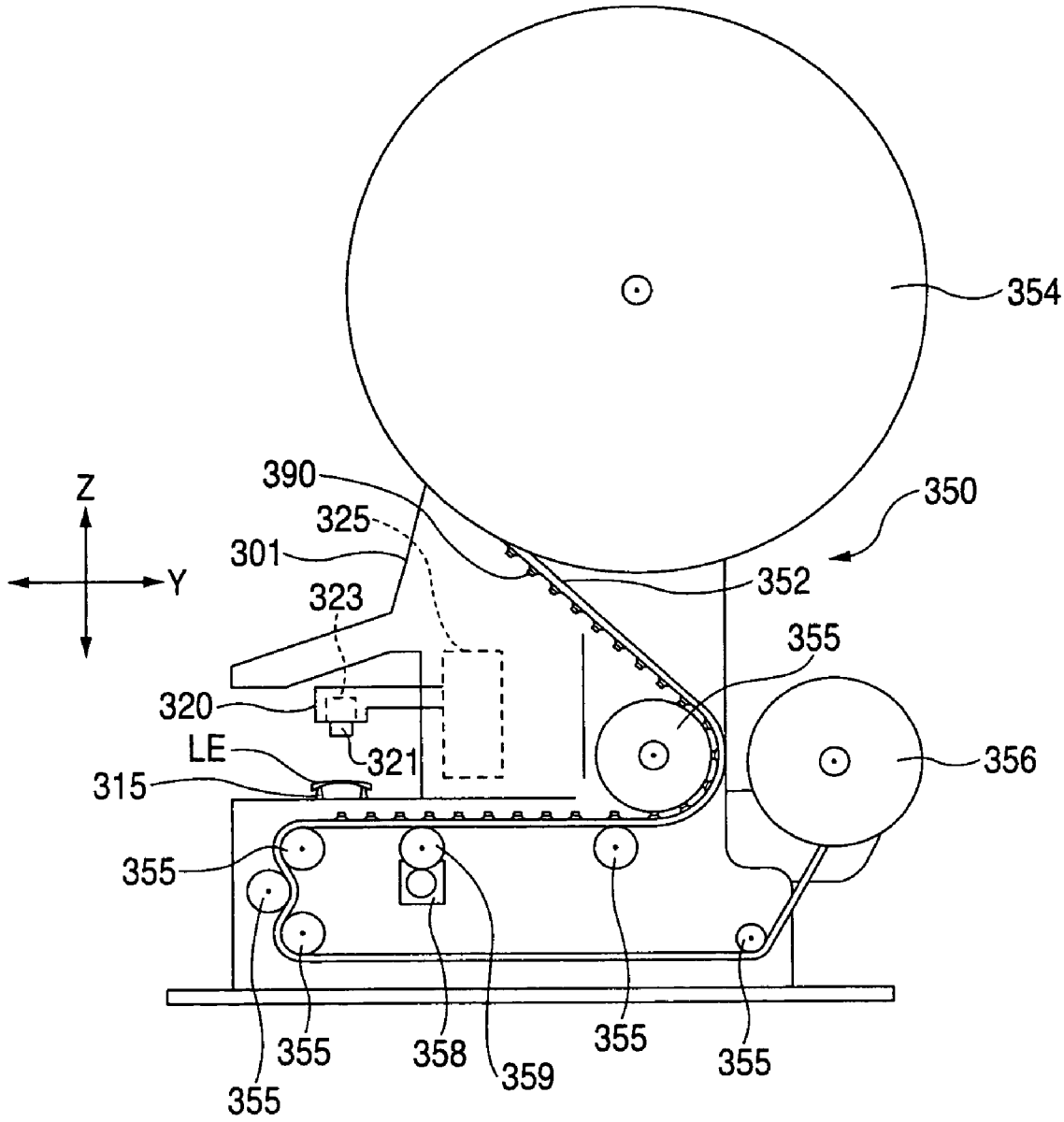
FIG. 9 is a schematic side elevational view of the blocking device.
Figure 10:
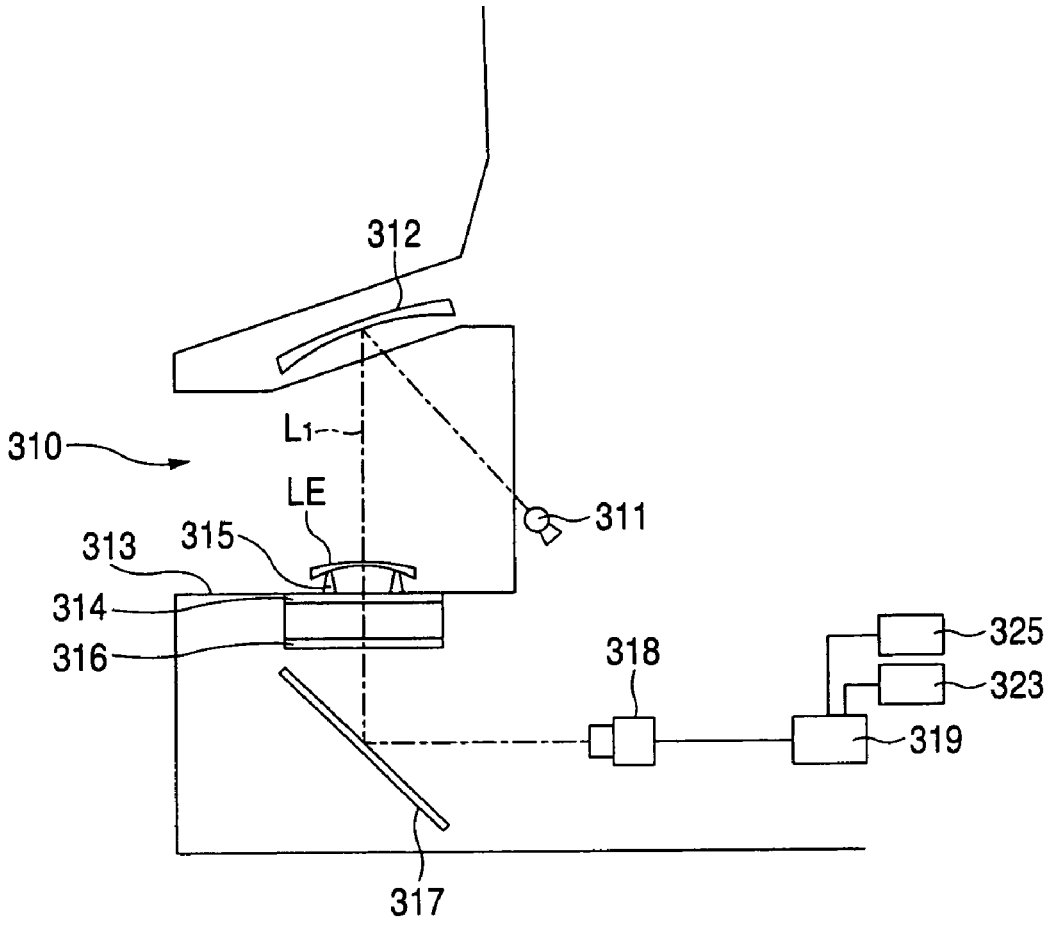
FIG. 10 is a schematic diagram of a measuring optical system of the blocking device.

Referring to FIGS. 8 to 10, a description will be given of the schematic construction of the blocking device 300. FIG. 8 is a schematic front elevational view of the blocking device 300, FIG. 9 is a schematic side elevational view thereof, and FIG. 10 is a schematic diagram of a measuring optical system.

The blocking device 300 is provided with a measuring optical system 310 for detecting the optical axis of the lens LE, an arm 320 for attaching the cup 390 to a front-side refractive surface of the lens LE, and a mechanism for moving this arm 320. Further, the blocking device 300 has a cup supplying section 350 for supplying the cups 390.

In FIG. 10, reference numeral 311 denotes an illuminating light source, and 312 denotes a concave mirror. The illumination light from the light source 311 is reflected by the concave mirror 312 along an optical axis L1 for measurement, and is converted into parallel rays of light. An index plate 314 is disposed on a lens table 313, and three supporting pins 315 for receiving the lens LE are provided thereon. The index plate 314 has a multiplicity of dot indices arranged in a grid form about the optical axis L1. A semitransparent screen plate 316 is disposed below the index plate 314, and a dot index image is projected onto it. A mirror 317 is disposed below the screen plate 316, and a CCD camera 318 is disposed in a direction of its reflection. The camera 318 picks up the dot index image projected onto the screen plate 316. A control unit 319 detects the optical center position and the cylindrical axis direction of the lens LE on the basis of an output signal from the camera 318. It should be noted that since the detection of the optical center position and the cylindrical axis direction based on dot indices are described in JP-A-11-287972 (U.S. Pat. No. 6,427,094) filed by the present applicant, reference is made thereto.

The arm 320 includes a fitting portion 321 for fitting the base portion 391 of the cup 390. A transverse key which is fitted to the transverse keyway 391*a* of the base portion 391 is formed inside the fitting portion 321, and is provided with a click mechanism for holding the cup 390 with an appropriate force so as to lift the cup 390 with its base portion 391 inserted therein. The fitting portion 321 is rotatable by a rotating mechanism 323 including a motor and the like. The arm 320 is movable in the horizontal direction (X and Y directions) and the vertical direction (Z direction) in FIGS. 8 and 9 by means of a moving mechanism 325 which is provided in a housing 301. The moving mechanism 325 includes a motor, a slide mechanism, and the like for moving the arm 320 in the respective X, Y, and Z directions. The control unit 319 moves the arm 320 in the X and Y directions by controlling the driving of the moving mechanism 325, so as to position the center of the cup 390 at the detected optical center position of the lens LE. In a case where the lens LE has a cylindrical axis, by controlling the driving of the rotating mechanism 323, the control unit 319 rotates the cup 390 for alignment with the cylindrical axis of the lens LE. Subsequently, the arm 320 is lowered downward to attach the cup 390 to the front-side refractive surface of the lens LE.

Figure 11:
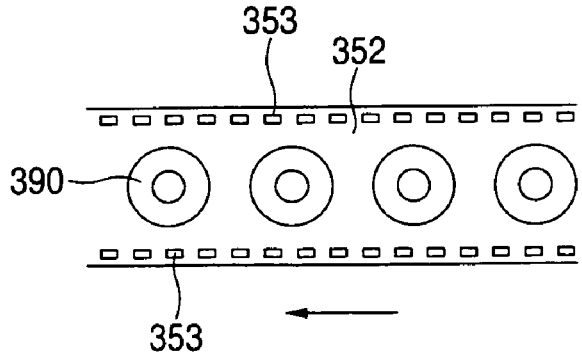
FIG. 11 is a diagram illustrating a tape with the cups adhering thereto.

A description will be given of the configuration of the cup supplying section 350. The cups 390 are attached in advance to predetermined positions of a tape 352 through the adhesive pads 398. The tape 352 with the cups 390 attached thereto is wound around a first reel 354. The tape 352 is taken up onto a second reel 356 via a plurality of rollers 355. Namely, the tape 352 is fed by a gear 359 which is threadedly engaged with a motor 358 disposed midway. At the same time, the rotation of the motor 358 is transmitted to the second reel 356 by an unillustrated belt. The gear 359 has pawls formed therein for engagement with perforations 353 (see FIG. 11) formed at widthwise both ends of the tape 352. The structure provided is such that the tape 352 is fed out by the rotation of the gear 359.

As for the cup 390 fed out to a predetermined position by the cup supplying section 350 having the above-described construction, its base portion 391 is fitted to the fitting portion 321 by the downward movement of the arm 320. Then, as the arm 320 is upwardly moved, the cup 390 is peeled off the tape 352 and is transported to the position where it is fitted to the lens LE.

<Tray (Lens) Stocking devices>

In FIGS. 1 and 2, the stocking devices 400*a* and 400*b* have the same construction, and each of the stocking devices 400*a* and 400*b* has stages 410 and 420 for placing the trays 401 thereon. The stages 410 and 420 are respectively moved vertically by lifting mechanisms 412 and 422. The trays 401 can be loaded on the stages 410 and 420 by being stacked vertically, and 10 trays 401 can be loaded on the respective stages. The tray 401 in which the processed lenses LE are accommodated is transferred from the stage 410 side to the stage 420 side by a hand portion 430. The hand portion 430 has two hands 431 and 432 for clamping the side surfaces of the tray 401. The hands 431 and 432 are arranged to be driven so as to approach toward and move away from each other by a moving mechanism portion 433. Further, the hands 431 and 432 are arranged to be moved in the left-and-right directions (lateral directions in FIGS. 1 and 2) by the moving mechanism portion 433.

It should be noted that two insertion holes (for a pair of left and right lenses), into which the base portions 391 of the cups 390 attached to the lenses LE are inserted, are provided in the tray 401. An ID tag 402, which is an identifier on which a work number has been registered, is provided on each tray 401. The work number of this ID tag 402 is read by an ID tag reader 440.

<Draining Device>

Figure 12:
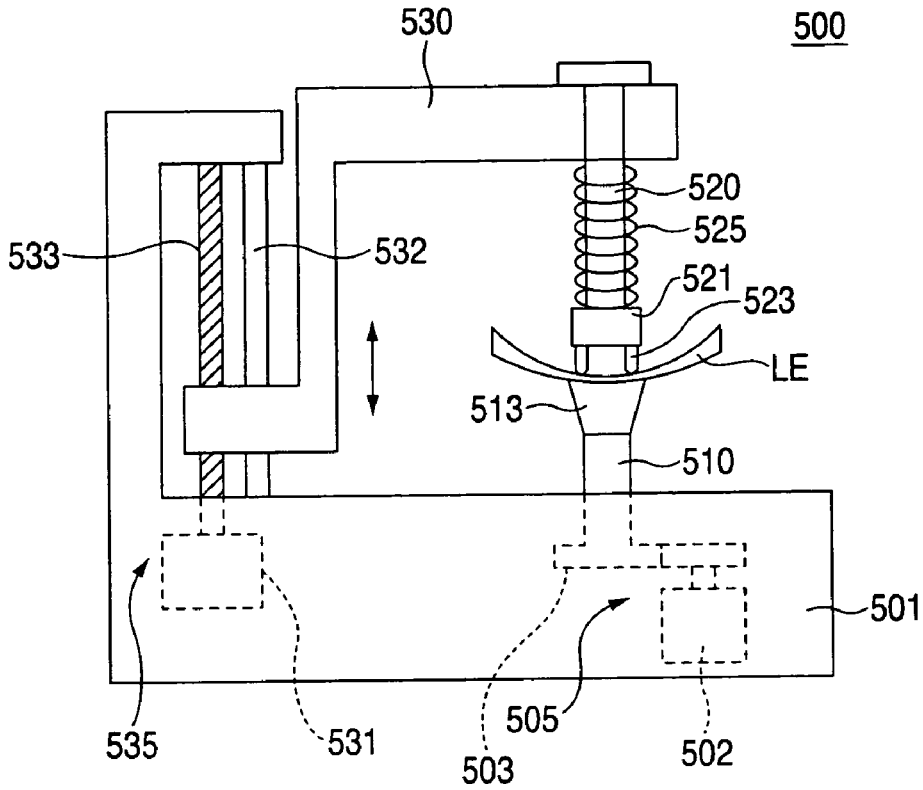
FIG. 12 is a schematic diagram of a draining device.

FIG. 12 is a schematic diagram of the draining device 500. The lens LE is chucked by two coaxial holding shafts 510 and 520. The lower holding shaft 510 is rotatably held on a base 501, and is rotated by a rotating mechanism 505 including a motor 502, a gear 503, and the like. A cup holder 513 is fixed to this holding shaft 510. This cup holder 513 has the same structure as that of the cup holder 113 shown in FIG. 5, and the cup 390 attached to the lens LE is fitted thereto. The upper holding shaft 520 has an axis coaxial with that of the holding shaft 510, and a lens pressing portion 521 is provided on the underside thereof. Three pins 523 for pressing the rear-side refractive surface of the lens LE are fixed to the lens pressing portion 521. The holding shaft 520 is rotatably held by an arm 530 which moves vertically. A spring 525 is inserted between the arm 530 and the lens pressing portion 521. The lens pressing portion 521 is constantly urged downward by this spring 525. As the arm 530 is lowered downward, the lens LE is held by the two holding shafts 510 and 520. The arm 530 is moved vertically by a vertically moving mechanism 535 including a motor 531, a guide rail 532, a feed screw 533, and the like.

Here, by rotating the lens LE at high speed, the rotating mechanism 505 causes the water attached to the lens LE to be blown off by a centrifugal force. The rotational speed at this time is preferably 2,500 rpm or more.

Next, a description will be given of the operation of the above-described system 1. Ordering data from optician's shops are inputted to the host PC 620 through a communication means such as the Internet. A work number is assigned to each piece of ordering data, and that work number is registered on the ID tag 402 attached to the tray 401 in which the lenses LE are accommodated. A pair of left and right lenses LE corresponding to the ordering data are accommodated in each tray 401 with their front-side refractive surfaces (convex surfaces) facing upward. Then, a plurality of trays 401 with the lenses LE accommodated therein are prepared, and are loaded in a stacked manner on the stage 410 of each of the stocking devices 400*a* and 400*b*. Since the stocking devices 400*a* and 400*b* are disposed on this side of the system 1, the loading and unloading of the trays 401 are facilitated.

Upon completion of the preparation of the trays 401, a start switch provided on the system control unit 600 is pressed to start the processing operation of the system 1. The system control unit 600 first raises the stage 410 on the stocking device 400*a* side, and causes the tray 401 placed at the very top to be located at a predetermined delivery position. The work number of the tray 401 is read by the reader 440 and is inputted to the system control unit 600. The system control unit 600 sends processing data corresponding to the work number to the processing device 100*a*. It should be noted that correspondence is provided such that the lenses LE on the stocking device 400*a* side are processed by the processing device 100*a*, and the lenses LE on the stocking device 400*b* side are processed by the processing device 100*b*.

The system control unit 600 operates the RH device 200 so as to effect processing starting with the lens LE for a right eye placed on the tray 401 on the stocking device 400*a* side (processing may be effected starting with the lens LE for a left eye). The RH device 200 moves along the movement path 30 to the stocking device 400*a* side, rotates the first arm 216 and the second arm 218, lowers the vertically sliding portion 214, and causes the sucking portion 222 provided at the distal end of the third arm 220 to be positioned on the lens LE for the right eye. Subsequently, the air pump 230 is driven. As a result, the lens LE for the right eye is sucked onto the sucking portion 222.

The RH device 200 holding the lens LE moves to a position above the lens table 313 of the blocking device 300 to convey the lens LE. Then, the driving of the air pump 230 is stopped to allow the lens LE to be placed on the supporting pins 315 of the lens table 313. After retreating the RH device 200, the system control unit 600 operates the blocking device 300.

The control unit 319 of the blocking device 300 detects the optical center position and the cylindrical axis direction of the lens LE. Further, by moving the arm 320 in the X and Y directions, the control unit 319 positions the fitting portion 321 on the cup 390 which has been supplied to a predetermined position by the cup supplying section 350. Then, the control unit 319 lowers the arm 320. As a result, the base portion 391 of the cup 390 is fitted to the fitting portion 321. Subsequently, as the arm 320 is raised, the cup 390 is peeled off the tape 352. At this time, the surface of the tape 352 has been treated such that the pad 398 is easily peeled off the tape 352 as attached to the cup 390 side. After the cup 390 has been peeled off the tape 352, the tape 352 is fed by the cup supplying section 350, and an ensuing cup 390 is set at a predetermined supplying position.

When the cup 390 has been fitted to the fitting portion 321, the control unit 319 moves the arm 320 in the X and Y directions so that the center of the cup 390 is aligned with the optical center position of the lens LE. In a case where the lens LE has a cylindrical axis, the fitting portion 321 is rotated such that the detected cylindrical axis direction and a reference direction for the fitting of the cup 390 come to assume a predetermined relation. Upon completion of this movement and rotation, the arm 320 is lowered. Consequently, the cup 390 is fitted to the front-side refractive surface of the lens LE. When the arm 320 is raised to a predetermined height, since the base portion 391 of the cup 390 remains fitted to the fitting portion 321, the lens LE is also lifted thereto. Subsequently, the arm 320 is moved so that the central position of the fitting of the fitting portion 321 is brought to a reference position for delivering the lens.

Upon completion of the fitting of the cup 390, the system control unit 600 operates the RH device 200 again. The RH device 200 moves to a lens conveying position of the blocking device 300, and sucks the lens LE which has been lifted by the fitting portion 321. At this time, the RH device 200 rotates the third arm 220 about the axis A3 to orient the sucking portion 222 upward. Then, after the suction bellows 224 is brought into contact with the rear-side refractive surface of the lens LE being lifted by the fitting portion 321, the lens LE is sucked by the driving of the air pump 230. As the vertically sliding portion 214 is lowered, the cup 390 together with the lens LE is drawn out from the fitting portion 321.

Next, the RH device 200 conveys the lens LE sucked onto the sucking portion 222 to the processing device 100*a*. As the third arm 220 is rotated about the axis A3, the RH device 200 orients the sucking portion 222 downward to cause the cup 390 fitted to the lens LE to be positioned on the lower side. By the rotative movement of the first arm 216 and the second arm 218, the center of the sucking portion 222 and the central axis of the chuck shaft 112 of the processing device 100*a* are aligned with each other. Subsequently, as the vertically sliding portion 214 is lowered, the base portion 391 of the cup 390 is fitted to the cup holder 113, thereby setting the lens LE on the chuck shaft 112. The sucking operation of the sucking portion 222 is canceled, and as the first arm 216 and the second arm 218 are rotatively moved, the third arm 220 is moved away from the processing device 100*a* side.

The control unit of the processing device 100*a* lowers the chuck shaft 111 by the vertically moving mechanism part 110, and the lens LE is held by chucking it in cooperation with the chuck shaft 112. Subsequently, on the basis of the data inputted from the system control unit 600, the grinding parts 150R and 150L are driven under control, and the peripheral edge of the lens LE is processed by the grinding wheels 151. This processing operation is described in JP-A-9-253999 (U.S. Pat. No. 5,716,256) filed by the present applicant, so that reference is made thereto.

After setting the lens LE for the right eye in the processing device 100*a*, the RH device 200 conveys the other lens LE for the left eye placed on the tray 401 to the blocking device 300. After the cup 390 has been fitted by the blocking device 300, the RH device 200 conveys the lens LE and returns it to the original tray 401 for ensuing processing.

During the processing of the lens LE by the processing device 100*a*, in order to cause the lens LE for the right eye placed on the tray 401 on the stocking device 400*b* side to be processed by the processing device 100*b* this time, the system control unit 600 operates the RH device 200 in the same way as described above to take out the lens LE from the tray 401 and convey it to the blocking device 300. When the cup 390 is fitted to the lens LE by the blocking device 300, the RH device 200 receives the lens LE, and sets the lens LE on the cup holder 113 of the chuck shaft 112 of the processing device 100*b*. After the third arm 220 of the RH device 200 is retreated, the processing device 100*b* chucks the lens LE by the chuck shafts 111 and 112, and starts processing. As preparation for ensuing processing, the RH device 200 which completed the conveyance to the processing device 100*b* conveys the lens LE for the left eye to the blocking device 300 so as to attach the cup 390 to that lens LE. The RH device 200 returns to the tray 401 the lens LE for which the attachment of the cup 390 has been completed.

When the processing of the lens LE by the processing device 100*a* is completed, the chuck shaft 111 is raised. The system control unit 600 operates the RH device 200 to fetch the processed lens LE. At this time, since the lens LE is placed on the chuck shaft 112 with its the rear-side refractive surface facing upward, the processing water used during the processing remains on that rear-side refractive surface. Before sucking and holding the lens LE, the RH device 200 delivers air from the suction bellows 224 by driving the air pump 230, thereby blowing off the water remaining on the lens LE. After that, the vertically sliding portion 214 is lowered to suck the lens LE by the sucking portion 222.

Although the water remaining on the rear-side refractive surface of the lens LE is removed to a certain degree by the delivering of the air from the suction bellows 224, the water attached to the front-side refractive surface and the rear-side refractive surface of the lens LE has not been removed sufficiently. If the water attached to the lens LE is kept as it is, it can cause water marks. To further remove the water attached to the lens LE, the RH device 200 conveys the processed lens LE taken out from the processing device 100*a* to the draining device 500.

In the same way as at the time of setting the lens LE to the processing device 100*a*, the RH device 200 conveys the lens LE to a position where the center of the sucking portion 222 and the center of the holding shaft 510 are aligned with each other. Then, the RH device 200 lowers the vertically sliding portion 214 to fit the base portion 391 of the cup 390 attached to the lens LE to the cup holder 513 attached to the holding shaft 510. Subsequently, the sucking operation of the sucking portion 222 is canceled, and the third arm 220 is retreated from the draining device 500 side. After the retreat of the third arm 220, the system control unit 600 lowers the arm 530 by driving the vertically moving mechanism 535, and the rear-side refractive surface of the lens LE is pressed by the lens pressing portion 521 of the holding shaft 520. Subsequently, by driving the rotating mechanism 505, the lens LE chucked by the two holding shafts 510 and 520 is rotated at high speed for about 3 seconds, whereby draining off the water attached to the rear-side refractive surface and the front-side refractive surface of the lens LE by the centrifugal force accompanying the rotation. Thus, the processing water attached to the lens LE is removed, and forced draining is thereby effected.

When the rotation of the lens LE on the draining device 500 is stopped, the RH device 200 sucks and holds the lens LE, and conveys and returns the lens to the tray 401 where that lens LE was accommodated.

When the processing of the lens LE by the processing device 100*b* has been completed, the lens LE is similarly taken out by the RH device 200, and the lens LE is conveyed to the draining device 500 to drain water off the lens, and is then returned to the original tray 401. After the lens LE is returned to the original tray 401, or in a case where the processing by the processing device 100*b* is underway, in order to process the other lens LE placed on the tray 401 on the stocking device 400*a* side, the lens LE attached to the cup 390 is conveyed to the processing device 100*a*, and processing is performed by the processing device 100*a*. After completion of the processing, the lens LE is subjected to draining by the draining device 500, and is returned to the original tray 401.

Upon completion of the processing of the pair of left and right lenses LE, the system control unit 600 controls the driving of the hand portion 430 to clamp the tray 401 with the processed lenses LE placed thereon by the hands 431 and 432 and to move it to the stage 420 side. Then, the stage 410 is raised by the lifting mechanism 412 to set an ensuing tray 401 to a predetermined position.

Thus, the lenses LE placed on the respective trays 401 of the stocking devices 400*a* and 400*b* are consecutively conveyed to the respective devices by the RH device 200, and processing is performed in parallel by the two processing devices 100*a* and 100*b*. If it is assumed that the processing time of 2 to 3 minutes is required for a single lens, since 10 trays 401 can be loaded on each of the stocking devices 400*a* and 400*b*, 40 lenses in total can be efficiently processed in slightly less than one hour by the two processing devices 100*a* and 100*b*. Further, since the conveyance of lenses between each of the two stocking devices 400*a* and 400*b* and each of the two processing devices 100*a* and 100*b* can be handled by one RH device 200, space saving is attained, and an economic advantage is offered.

Figure 13:
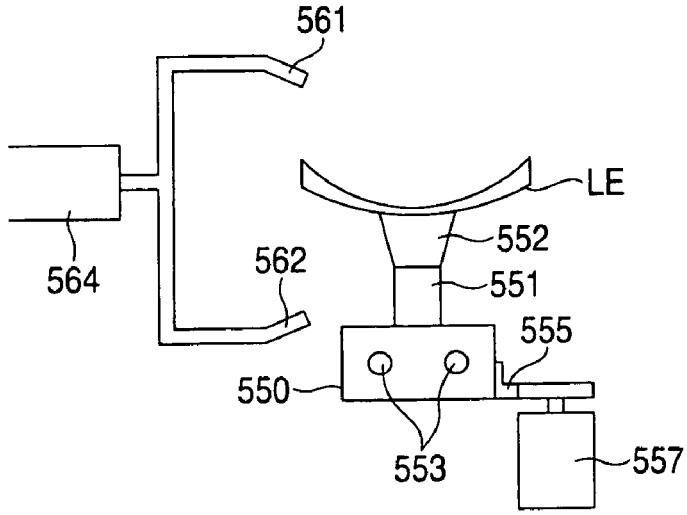
FIG. 13 is a schematic diagram illustrating another example of the draining device.

FIG. 13 is a schematic diagram illustrating another example of the draining device 500. A fixing shaft 551 is attached to a moving block 550, and a cup holder 552 is fixed to an upper portion of the fixing shaft 551. This cup holder 552 has the same structure as that of the cup holder 113 shown in FIG. 5, and the cup 390 attached to the lens LE is fitted thereto. Two rails 553 extending in a direction perpendicular to the plane of the drawing of FIG. 13 are passed through the moving block 550, and the moving block 550 is movable along the rails 553. A rack 555 extending in parallel with the rails 553 is attached to a side surface of the moving block 550, and a pinion of a motor 557 meshes with this rack 555. As the motor 557 is driven and rotated, the lens LE held by the cup holder 113 is moved in the direction perpendicular to the plane of the drawing of FIG. 13.

Reference numerals 561 and 562 denote air nozzles for jetting compressed air. The air nozzle 561 and the air nozzle 562 are respectively provided on an unillustrated housing at a position for blowing air toward the rear-side refractive surface of the lens LE held by the cup holder 552 and at a position for blowing air toward the front-side refractive surface of the lens LE. Air is supplied from an air pump 564 to the air nozzles 561 and 562.

In this construction, after the lens LE is set on the cup holder 552 by conveyance by the RH device 200, as the motor 557 is driven to be rotated while blowing compressed air from the air nozzles 561 and 562, the lens LE held by the cup holder 113 is moved in the direction perpendicular to the plane of the drawing of FIG. 13. By virtue of the air blown from the air nozzles 561 and 562, the water attached to the rear-side refractive surface and the front-side refractive surface of the lens LE is blown off, and forced draining is thereby effected.

As described above, in accordance with the invention, saving the processing step is made possible by saving the draining step of removing the water attached to the lens.

What is claimed is:

1. A lens processing system comprising:

a lens processing device which processes a lens while spraying processing water on the lens; and a draining device which rotates the processed lens to remove the processing water attached to the processed lens by centrifugal force;

wherein the lens processing device comprises a first lens holding part to which a cup attached to the lens can be fitted and a lens processing member which processes the lens held by the first lens holding part; and wherein the draining device comprises a second lens holding part to which the cup attached to the lens can be fitted and a rotating unit which rotates the second lens holding part.

2. The lens processing system according to claim 1, wherein the second lens holding part comprises two coaxial holding shafts between which the lens is chucked.

3. A lens processing system comprising:

a lens processing device which processes a lens while spraying processing water on the lens; and a draining device which rotates the processed lens to remove the processing water attached to the processed lens by centrifugal force;

wherein the draining device rotates the lens at 2500 rpm or more.

4. A lens processing system comprising:

a lens processing device which processes a lens while spraying processing water on the lens;

a draining device which rotates the processed lens to remove the processing water attached to the processed lens by centrifugal force;

a lens conveying device which conveys the processed lens from the lens processing device to the draining device.

* * * * *